US006981557B2

(12) United States Patent
Boeni et al.

(10) Patent No.: US 6,981,557 B2
(45) Date of Patent: Jan. 3, 2006

(54) PROCESS FOR CONTROLLING AN AXIALLY HAMMERING AND ROTATING ELECTRIC HAND-HELD MACHINE TOOL

(75) Inventors: Hans Boeni, Buchs/SG (CH); Roland Schaer, Grabs (CH); Harald Schmitzer, Werdenberg (CH); Ricardo Teixeira, Feldkirch (CH); Christoph Wuersch, Werdenberg (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/790,171

(22) Filed: Mar. 1, 2004

(65) Prior Publication Data

US 2004/0226728 A1 Nov. 18, 2004

(30) Foreign Application Priority Data

Mar. 1, 2003 (DE) ..... 103 09 012

(51) Int. Cl.
*B25F 5/00* (2006.01)

(52) U.S. Cl. ..... 173/1; 173/2; 173/176; 173/178

(58) Field of Classification Search ..... 173/176, 173/178, 47, 48, 217, 2, 181, 182, 1
See application file for complete search history.

(56) References Cited

U.S. PATENT DOCUMENTS

| | | | | |
|---|---|---|---|---|
| 5,076,120 | A | 12/1991 | Lin | |
| 5,401,124 | A * | 3/1995 | Hettich | 173/176 |
| 5,868,208 | A * | 2/1999 | Peisert et al. | 173/178 |
| 5,914,882 | A * | 6/1999 | Yeghiazarians | 408/9 |
| 5,996,707 | A * | 12/1999 | Thome et al. | 173/176 |
| 6,044,918 | A * | 4/2000 | Noser et al. | 173/176 |
| 6,111,515 | A * | 8/2000 | Schaer et al. | 340/680 |
| 6,415,875 | B1 * | 7/2002 | Meixner et al. | 173/176 |
| 6,484,814 | B2 * | 11/2002 | Bongers-Ambrosius | 173/176 |
| 6,843,327 | B2 * | 1/2005 | Meixner et al. | 173/176 |
| 6,863,165 | B2 * | 3/2005 | Koslowski | 173/178 |

FOREIGN PATENT DOCUMENTS

| | | |
|---|---|---|
| DE | 3707052 | 9/1988 |
| EP | 0202130 | 10/1990 |

* cited by examiner

*Primary Examiner*—Scott A. Smith
(74) *Attorney, Agent, or Firm*—Abelman, Frayne & Schwab

(57) ABSTRACT

A control process for an at least partially axially hammering and rotating electric hand-held machine tool (1) in which an electromagnetic clutch (4) arranged in the flow of force between an electric motor (2) and a tool receptacle (3) is controllably connected to computing device (5) connected to sensors (6*a*, 6*b*, 6*c*), wherein the clutch (4) is repeatedly alternately opened and closed in at least one process step controlled by the computing device (5).

5 Claims, 2 Drawing Sheets

PROCESS FOR CONTROLLING AN AXIALLY HAMMERING AND ROTATING ELECTRIC HAND-HELD MACHINE TOOL

BACKGROUND OF THE INVENTION

The invention is directed to a process for controlling an at least partially axially hammering and rotating electric hand-held machine tool such as a combination hammer or a chisel hammer.

According to DE 3707052, an axially hammering and rotating electric hand-held machine tool has an electromagnetic safety clutch in the flow of force between an electric motor and a tool receptacle. This electromagnetic safety clutch is controllably connected to a microcontroller which is connected to sensors and whose controlling process interrupts the flow of force in case of tool blockage.

In addition, according to U.S. Pat. No. 5,076,120, an electric impact screwing device has a low-power electric motor, a gear unit and an electromagnetic clutch behind the in the flow of force. The electrorate of rotation during free run-up of the magnetic clutch triggers tangential impacts since it is switched on and off depending upon the he electric motor and, respectively, deceleration by the workpiece.

SUMMARY OF THE INVENTION

It is the object of the invention to realize an at least partially axially hammering and rotating electric hand-held machine tool with a control process for generating tangential impacts.

This object is achieved in accordance with the invention by a control process for an axially hammering and rotating electric hand-held machine tool in which an electromagnetic clutch which is controllably connected to computing means connected to sensors is arranged in the flow of force between an electric motor and a tool receptacle, the safety clutch is repeatedly alternately opened and closed in at least one process step controlled by the computing means.

Due to the repeatedly alternately opened and closed safety clutch, tangential impacts which are energized through the mass moment of inertia of the electric motor are generated against the machining resistance of a tool connected to the tool receptacle.

In this process step, the clutch is advantageously alternately opened and closed at a frequency between 20 Hz and 100 Hz so that the frequency of the tangential impacts is substantially greater than the inherent or natural frequency of the electric hand-held machine tool guided by the hand-arm system.

In an advantageous manner, also with respect to a rotation of the housing or slip of the clutch, this process step is initiated in the event of an impending tool blockage detected by the computing means via the sensor such that the tool blockage can be averted at least in some cases by the tangential impacts.

The sensor is advantageously constructed as a metal detector, e.g., as a leakage current detector, a capacitive or inductive proximity switch, and so forth, so that the probability of tool blockage can be reduced by the initiated tangential impacts particularly during hammer drilling in concrete when hitting reinforcing iron.

The computing means are advantageously connected to a switch, e.g., a feeler, which can be actuated manually and by which this process step can be initiated manually so that these tangential impacts can be preselected manually.

An at least partially axially hammering and rotating electric hand-held machine tool, in which an electromagnetic clutch which is controllably connected to computing means connected to sensors is arranged in the flow of force between an electric motor and a tool receptacle, is substantially controllable by the computing means using a control process of the kind mentioned above.

With an electromagnetic clutch advantageously constructed in the form of a safety clutch, electric hand-held machine tools protected against tool blockage can be expanded by a control process of this type in such a way that the probability of tool blockage can be actively reduced. For this purpose, corresponding software algorithms are implemented in the computing means which are advantageously constructed in the form of a microcontroller.

BRIEF DESCRIPTION OF THE DRAWINGS

The invention will be described more fully with reference to the drawings, wherein.

DETAILED DESCRIPTION OF THE INVENTION

Figure 1:
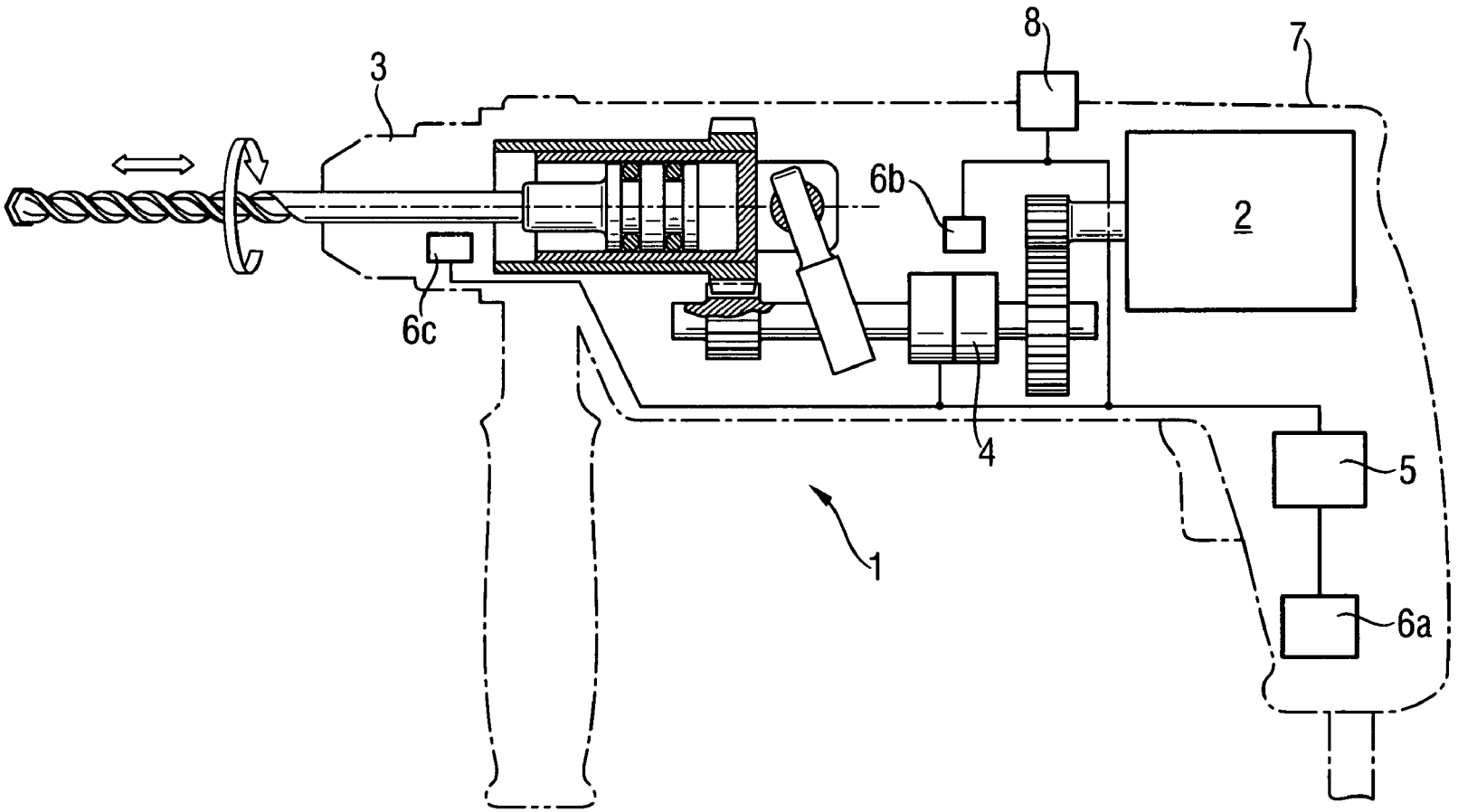
FIG. 1 shows an electric hand-held machine tool in accordance with the invention.

According to FIG. 1, an axially hammering and rotating electric hand-held machine tool 1 in the form of a drill hammer has an electromagnetic clutch 4 in the flow of force between an electric motor 2 and a tool receptacle 3. The electromagnetic clutch 4 is constructed as a safety clutch and is controllably connected to computing means 5 which are constructed as a microcontroller and connected to sensors 6*a*, 6*b*, 6*c*. Sensor 6*a* is an acceleration sensor which is arranged in the housing 7 of the electric hand-held machine tool 1. Sensor 6*b* is a slip sensor arranged in the clutch 4. Sensor 6*c* is a leakage current sensor which is arranged in the tool receptacle 3. A switch 8 which can be actuated manually is arranged outside at the housing 7 and is controllably connected with the computing means 5.

Figure 2:
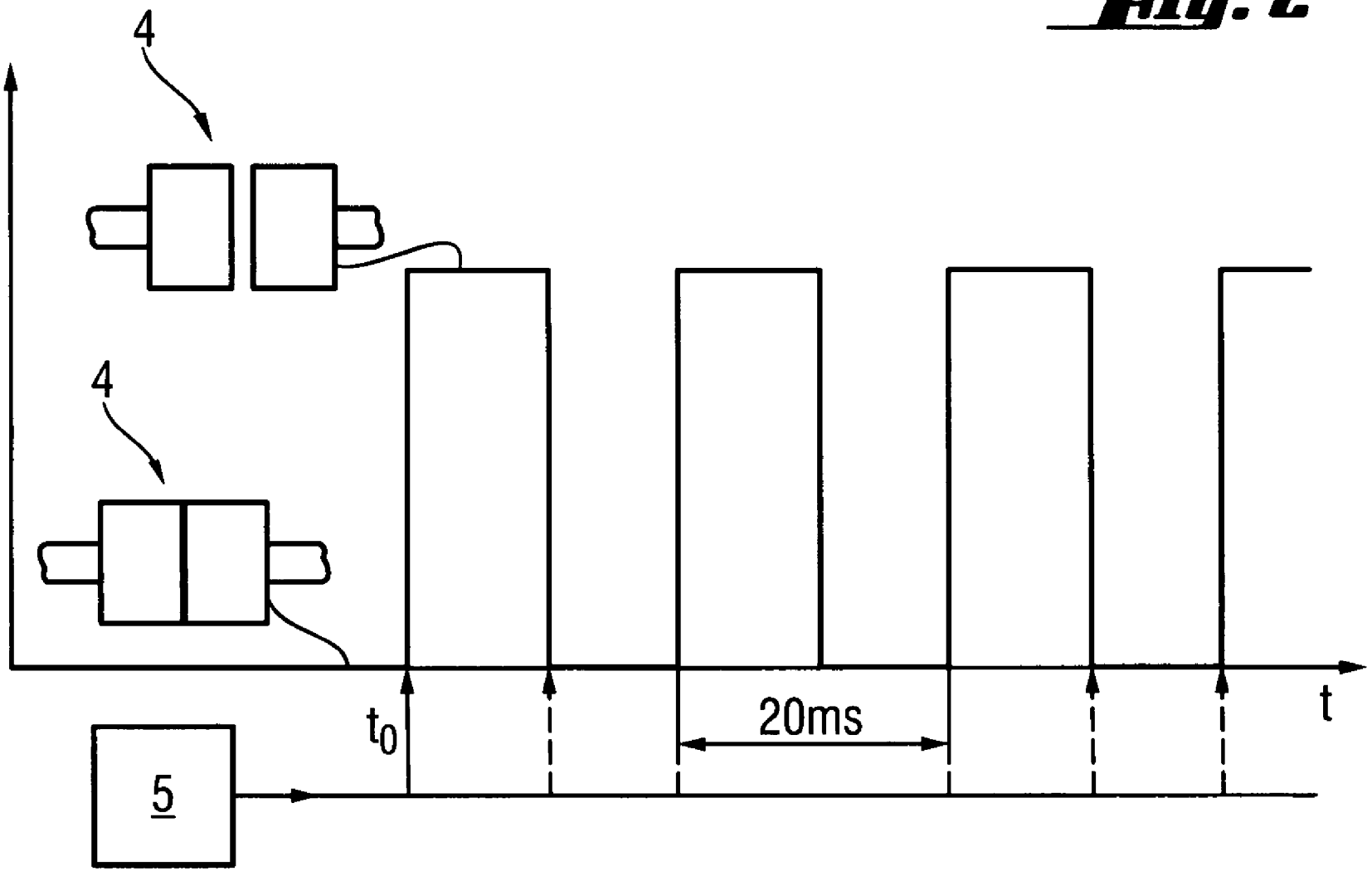
FIG. 2 shows a control process in accordance with the invention.

According to FIG. 2, in a process step initiated by the computing means 5 at time $t_0$, the clutch 4 is repeatedly alternately opened and closed. The period during which the electromagnetic clutch 4 is alternately opened and closed is 20 ms, which corresponds to a frequency of 50 Hz.

What is claimed:

1. A control process for an at least partially axially hammering and rotating electric hand-held machine tool (1) wherein an electromagnetic clutch (4) arranged in the flow of force between an electric motor (2) and a tool receptacle (3) is controllably connected to computing means (5) connected to at least one sensor (6*a*, 6*b*, 6*c*), wherein the clutch (4) is repeatedly alternately opened and closed in at least one process step controlled by the computing means (5).

2. The control process of claim 1, wherein the clutch (4) is alternately opened and closed at a frequency between 20 Hz and 100 Hz in the process step.

3. The control process of claim 1, wherein the process step is initiated in the event of an impending tool blockage detected by the computing means (5) via the sensor (6*a*, 6*b*, 6*c*), with respect to one of a rotation of a housing (7) of the electric hand-held machine tool (1), slippage of the clutch (4), and detection of metal.

4. The control process of claim 1, wherein the process step can be initiated manually by a switch (8) that is connected to the computing means (5) and that can be actuated manually.

5. An electric hand-held machine tool with an at least partially axially hammering and rotating driving means of a tool receptacle (3) wherein an electromagnetic clutch (4) that is controllably connected to computing means (5) connected to at least one sensor **(6*a*, 6*b*, 6*c*) is arranged in the flow of force between an electric motor (2) and a tool receptacle (3), wherein the electromagnetic clutch (4) is controllable by computing means (5) using a control process wherein the clutch (4) is repeatedly alternately opened and closed in at least one process step controlled by the computing means (5)**.

* * * * *